US011217898B1

(12) United States Patent
Krawczyk et al.

(10) Patent No.: US 11,217,898 B1
(45) Date of Patent: Jan. 4, 2022

(54) CONTINUOUS ANTENNA ARRAYS

(71) Applicant: Triad National Security, LLC, Los Alamos, NM (US)

(72) Inventors: Frank L. Krawczyk, Los Alamos, NM (US); John Singleton, Los Alamos, NM (US); Andrea Caroline Schmidt, Los Alamos, NM (US)

(73) Assignee: Triad National Security, LLC, Los Alamos, NM (US)

( * ) Notice: Subject to any disclaimer, the term of this patent is extended or adjusted under 35 U.S.C. 154(b) by 0 days.

(21) Appl. No.: 16/529,720

(22) Filed: Aug. 1, 2019

Related U.S. Application Data

(60) Provisional application No. 62/721,031, filed on Aug. 22, 2018.

(51) Int. Cl.

| | |
|---|---|
| ***H01Q 21/00*** | (2006.01) |
| ***H01Q 1/48*** | (2006.01) |
| ***H01Q 21/22*** | (2006.01) |
| ***H01Q 9/30*** | (2006.01) |
| ***H01Q 1/38*** | (2006.01) |

(52) U.S. Cl.
CPC ..... *H01Q 21/0025* (2013.01); *H01Q 1/38* (2013.01); *H01Q 1/48* (2013.01); *H01Q 9/30* (2013.01); *H01Q 21/0075* (2013.01); *H01Q 21/22* (2013.01)

(58) Field of Classification Search
CPC ..... H01Q 21/0025; H01Q 21/0075; H01Q 21/22; H01Q 9/30; H01Q 1/38; H01Q 1/48; H01Q 9/0485
See application file for complete search history.

(56) References Cited

U.S. PATENT DOCUMENTS

2013/0201073 A1* 8/2013 Singleton ..... H01Q 1/50 343/859

FOREIGN PATENT DOCUMENTS

WO WO-2017083100 A2 * 5/2017 ..... H01Q 13/22

* cited by examiner

*Primary Examiner* — Seokjin Kim
(74) *Attorney, Agent, or Firm* — LeonardPatel PC

(57) ABSTRACT

A continuous antenna array includes a plurality of antenna elements whose opposing electrodes create an electric field that excites polarization currents in an enclosed dielectric. Each of the antenna elements comprises one or more strip-line feeds configured to provide a flat form factor and apply a signal with controlled phase differences between the plurality of antenna elements.

19 Claims, 8 Drawing Sheets

CONTINUOUS ANTENNA ARRAYS

CROSS-REFERENCE TO RELATED APPLICATION

This application claims the benefit of U.S. Provisional Patent Application No. 62/721,031 filed Aug. 22, 2018. The subject matter of this earlier-filed application is hereby incorporated by reference in its entirety.

STATEMENT OF FEDERAL RIGHTS

The United States government has rights in this invention pursuant to Contract No. 89233218CNA000001 between the United States Department of Energy and Triad National Security, LLC for the operation of Los Alamos National Laboratory.

FIELD

The present invention generally relates to antenna arrays, and more particularly, continuous antenna arrays for surface mounting and rugged environments.

BACKGROUND

Phased arrays are commonly used in commercial and defense applications. For example, in defense applications that require mobility, phased arrays exhibit fragility based on their makeup from dipole antennas. These dipole antennas require a fixed wavelength-related spacing and a support structure with lots of void to minimize materials interfering with radiation.

Recent publications indicate a need for antennas that are more rugged, surface mountable, broadband and have large redundancy. While traditional phased arrays provide only marginal support to address these needs, an alternative to phased arrays may be more beneficial.

SUMMARY

Certain embodiments of the present invention may provide solutions to the problems and needs in the art that have not yet been fully identified, appreciated, or solved by conventional antenna arrays. For example, some embodiments of the present invention pertain to a continuous antenna array that is rugged and mounted to the surface, e.g., as part of a ceramic armor, and are largely superior to phased arrays in terms of redundancy based on arbitrary compact element spacing. The continuous nature of the dielectric emitter supports future applications requiring a broad band of frequencies.

In an embodiment, an apparatus may include a plurality of antenna elements whose opposing electrodes create an electric field that excites polarization currents in an enclosed dielectric. Each of the antenna elements comprises one or more stripline feeds configured to provide a flat form factor and to apply a signal with controlled phase difference between the plurality of antenna elements.

In another embodiment, an antenna array is used as drop-in replacement for phased arrays or for applications that could not be achieved with a flat panel surface mount and conformal shaping to fit mounting surfaces. The antenna array includes an extended dielectric with volume-distributed polarization currents flowing therein emitting radiation. The extended dielectric is continuous or is a series of dielectrics joined together to form an extended shape. The antenna array also includes one or more pairs of electrodes distributed on one or more edges of the extended dielectric generate the polarization currents. The one or more pairs of electrodes with the extended dielectric between the one or more pairs of electrodes for the antenna array.

BRIEF DESCRIPTION OF THE DRAWINGS

In order that the advantages of certain embodiments of the invention will be readily understood, a more particular description of the invention briefly described above will be rendered by reference to specific embodiments that are illustrated in the appended drawings. While it should be understood that these drawings depict only typical embodiments of the invention and are not therefore to be considered to be limiting of its scope, the invention will be described and explained with additional specificity and detail through the use of the accompanying drawings, which are as follows.

DETAILED DESCRIPTION OF THE EMBODIMENTS

Some embodiments generally pertain to an advanced antenna array that can be used as drop-in replacement for phased arrays (with operational advantages) or as an antenna for applications that could not be achieved with traditional technology such as flat panel surface mount and conformal shaping to fit mounting surfaces.

In some embodiments, emitted radiation is generated by volume-distributed polarization currents that flow through an extended dielectric. The dielectric may be a continuous volume or a series of smaller pieces joined together to make an extended shape. The polarization currents may be generated by pairs of electrodes distributed on the edges of the dielectric. Each pair of electrodes, and the dielectric between, constitutes an element of the antenna.

In some additional embodiments, the antenna array is based on a solid dielectric block with cut-outs of a simple geometry. The cut-outs are plated to provide the electrodes and shielding. These cut-outs also hold the block or blocks of dielectric that contain the polarization currents (the polarization dielectric) in place between the electrodes. The antenna elements may replace the Hertzian dipoles of a traditional phased array. The mechanical stability of the resulting antenna and the local shape of the electric fields within the dielectric result in superior performance.

It should be noted that the boundary conditions in the dielectric mean that the electric field in each element of the new antenna is oriented in a single direction (unlike the "orbital" fields produced by conventional dipole elements). This is potentially very efficient. For example, tests have shown small sections of such an antenna emitting more efficiently than a comparable array made from conventional dipoles. The orientation also permits the elements to be packed arbitrarily densely; their spacing is not driven by the topology and neighbor-to-neighbor coupling of fields, but by the space required to independently drive each element (which is a much smaller fraction of a wavelength) than in a traditional phased array.

The use of simple dielectric geometric elements and electrode arrangements fabricated, for example, by metallization may lead to configurations that can easily be machined or 3D-printed without manual intervention. These can be configured for a flat form-factor or can be formed into a curved shape to match non-flat mounting surfaces. A wide range of final shapes is possible, as long as the field direction among adjacent array elements is sufficiently simple and close to parallel.

Figure 1:
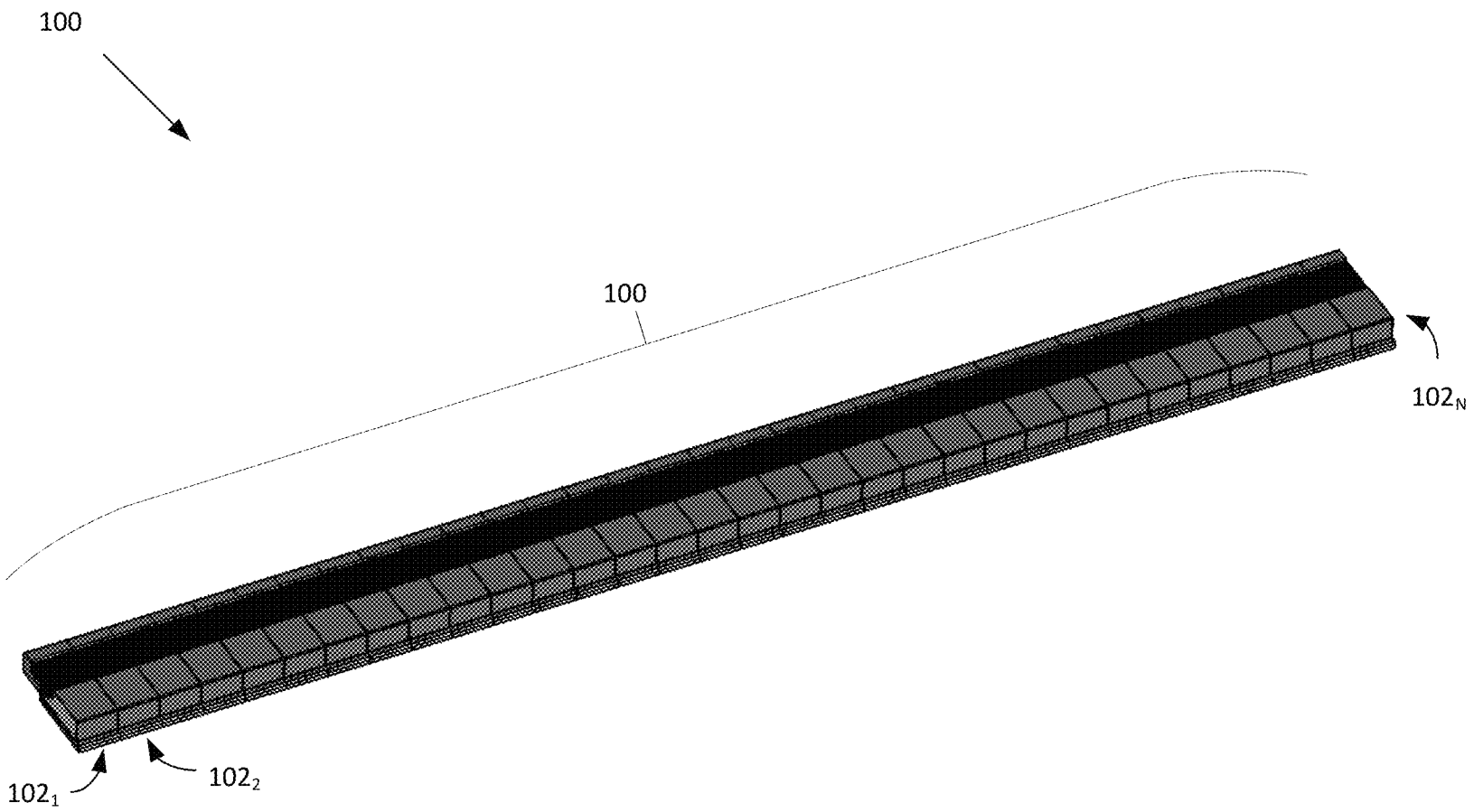
FIG. 1 is a schematic diagram illustrating an antenna array, according to an embodiment of the present invention.

FIG. 1 is a diagram illustrating an antenna array 100, according to an embodiment of the present invention. FIG. 1 represents a linear, flat arrangement of elements. Other embodiments include arcs, waves, circles, panels with conformal curvature and multiple densely packed arrays. In this embodiment, antenna array 100 includes a plurality of elements $\mathbf{102}_1$, $\mathbf{102}_2$, . . . $\mathbf{102}_N$. The dielectric radiators in each element $\mathbf{102}_1$, $\mathbf{102}_2$, . . . $\mathbf{102}_N$ may touch at edges that are parallel or close to parallel to the polarization currents inside the dielectric. In some embodiments, the arrangement of elements $\mathbf{102}_1$, $\mathbf{102}_2$, . . . $\mathbf{102}_N$ may be linear, curved, circular, or have other convenient shapes. Such arrangements may be optimized for specific uses.

Figure 2A:
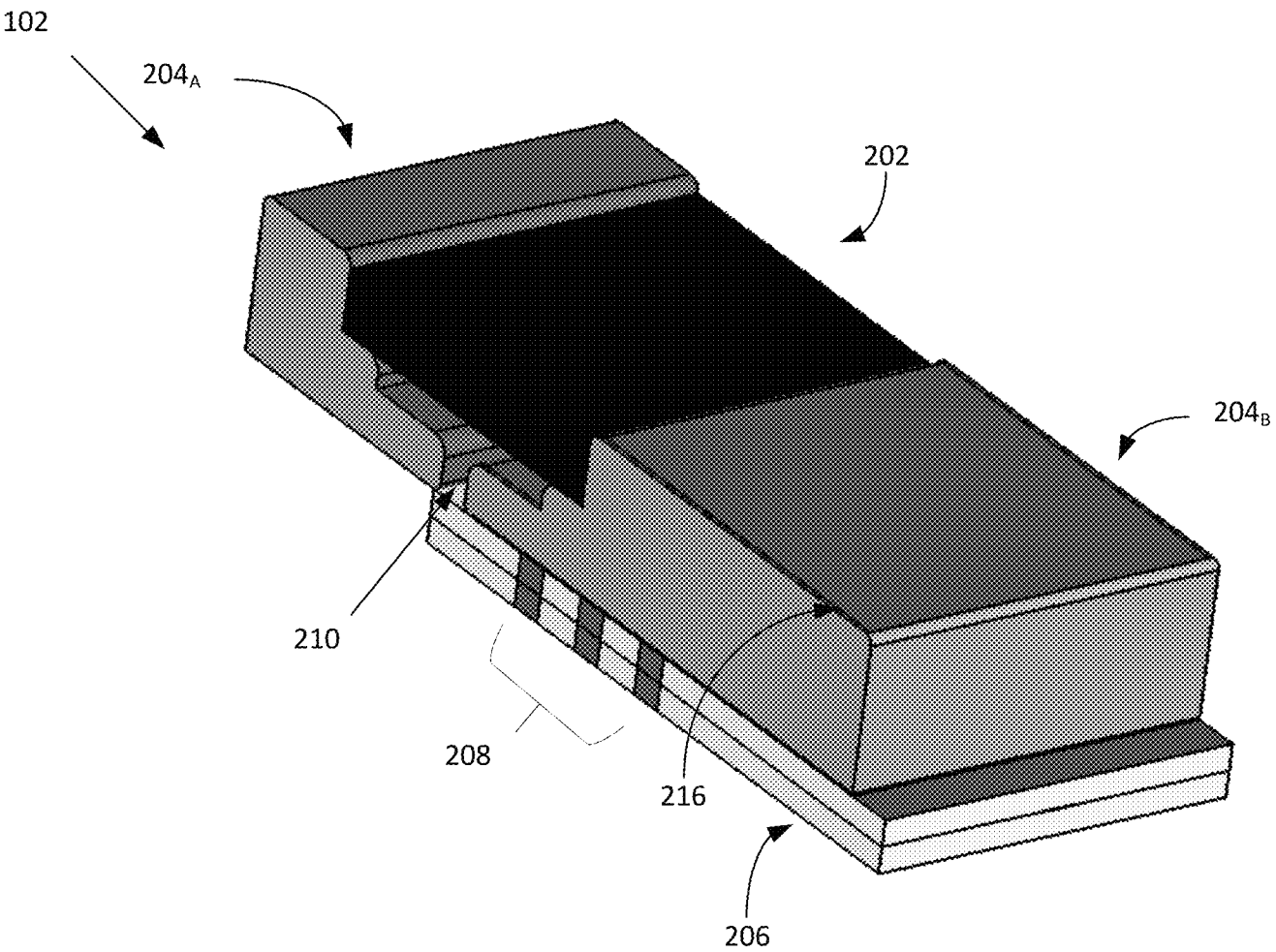
FIGS. 2A-G are schematic diagrams illustrating an array element, according to an embodiment of the present invention.
Figure 2B:
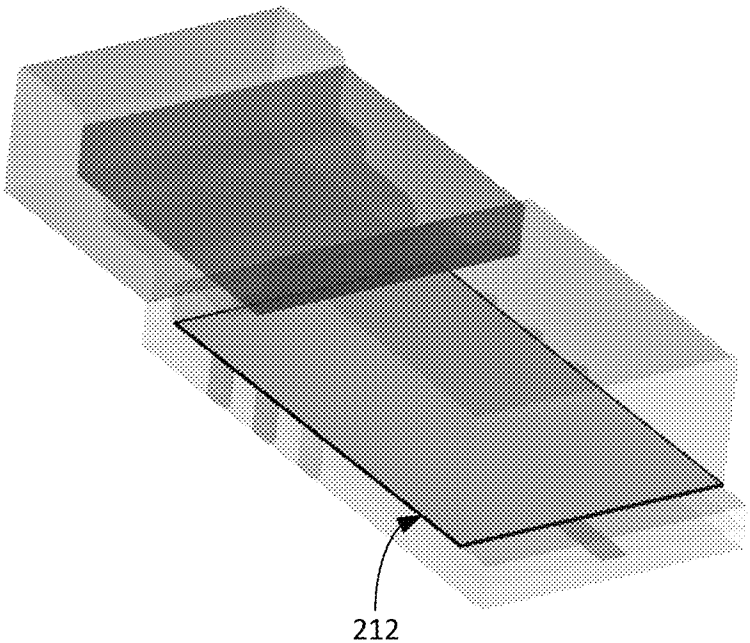
Figure 2C:
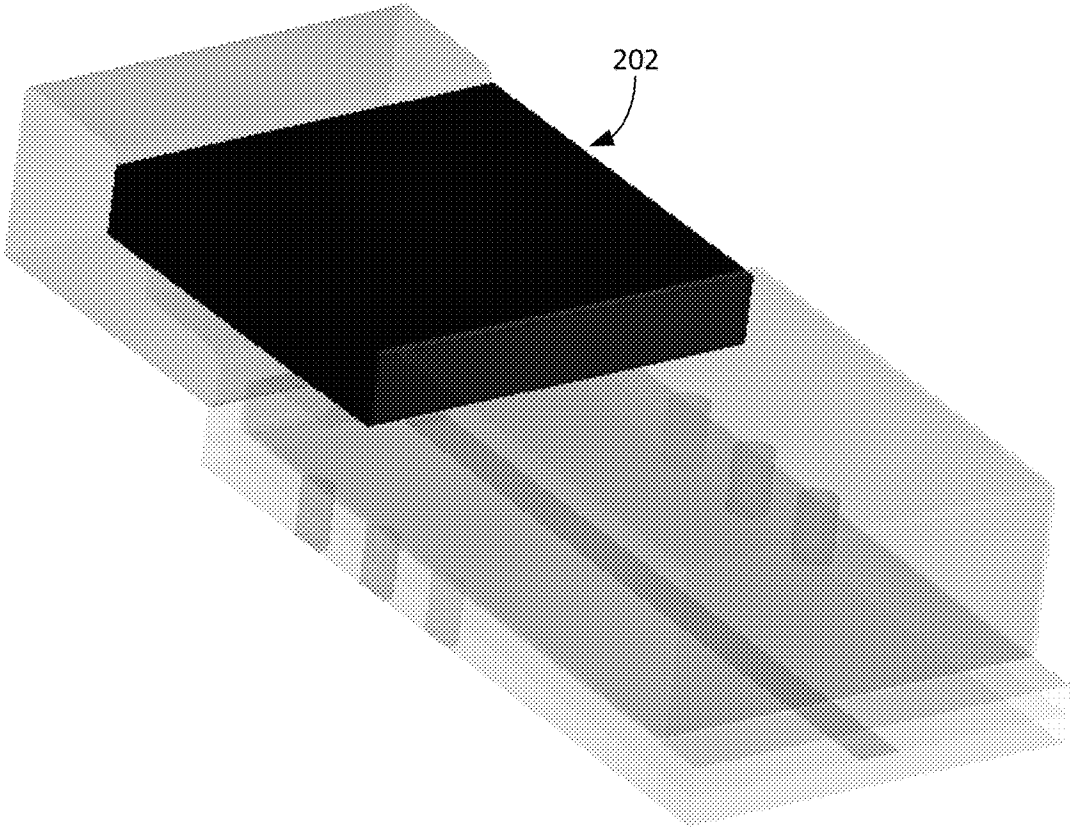
Figure 2D:
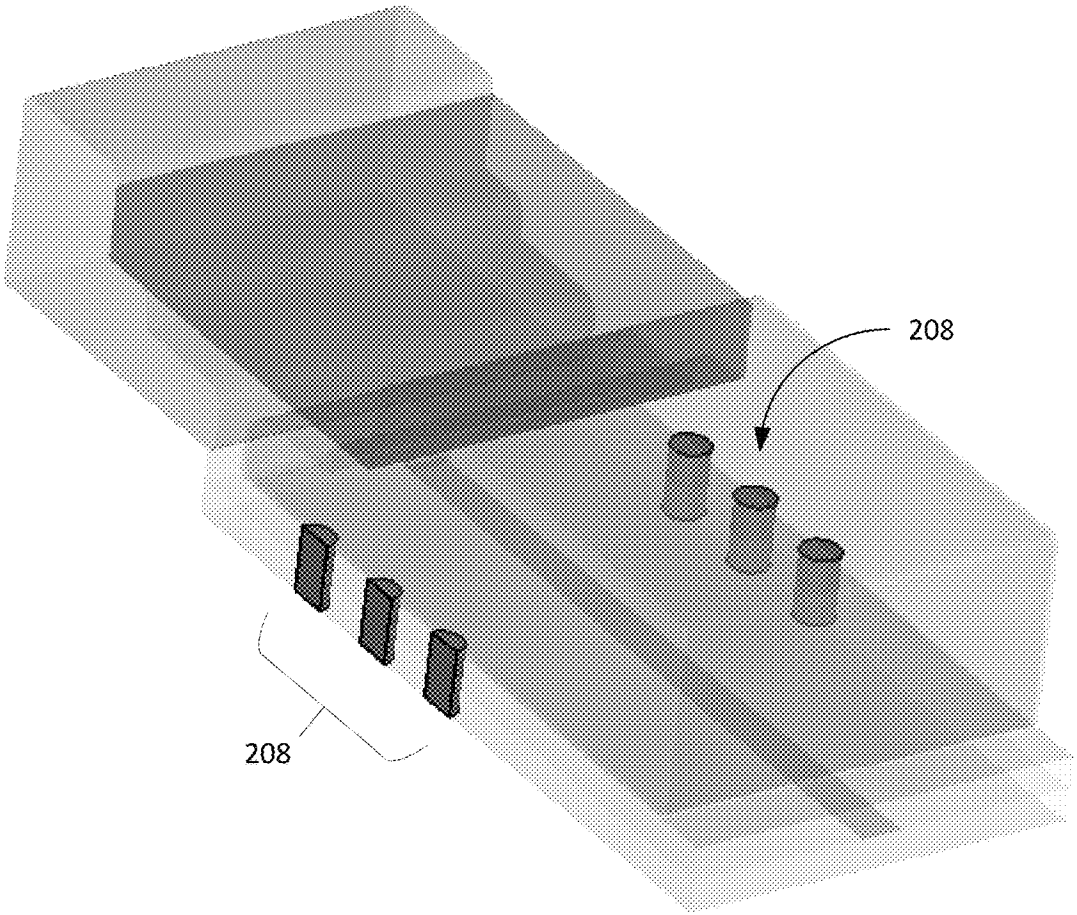
Figure 2E:
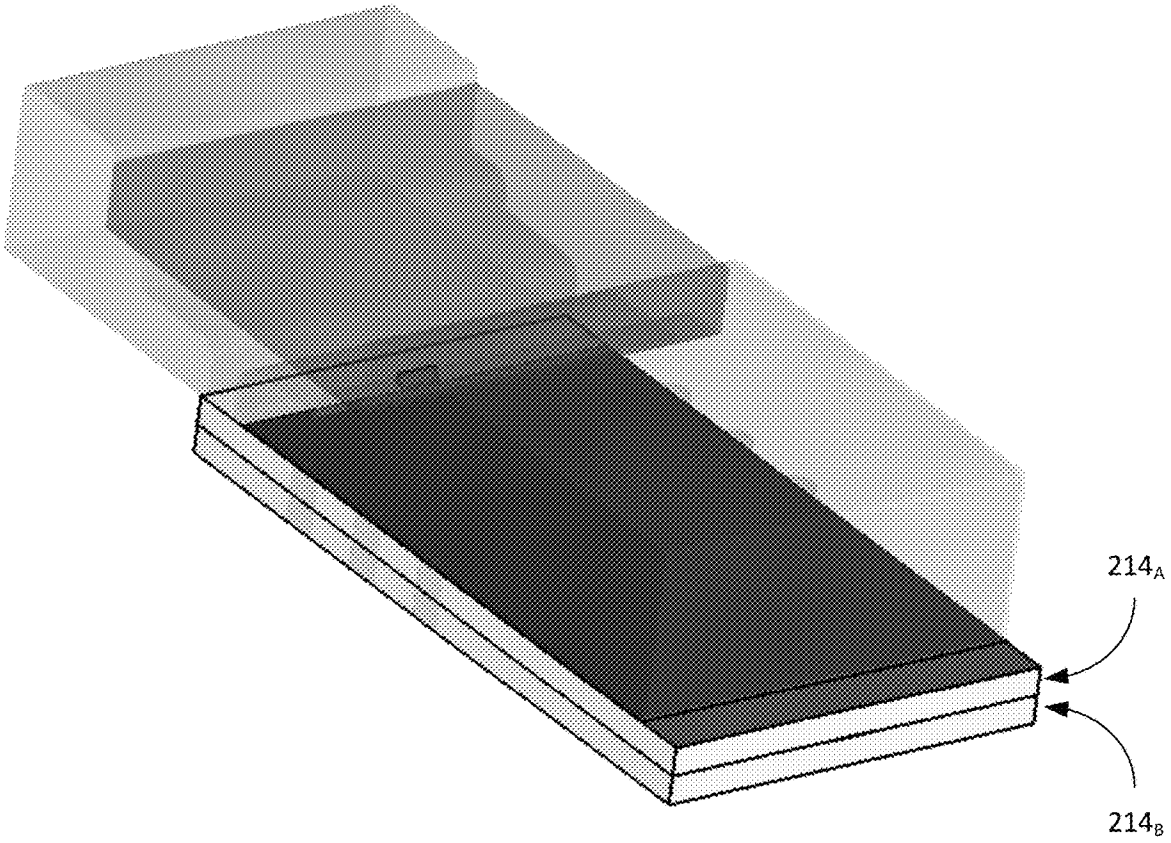
Figure 2F:
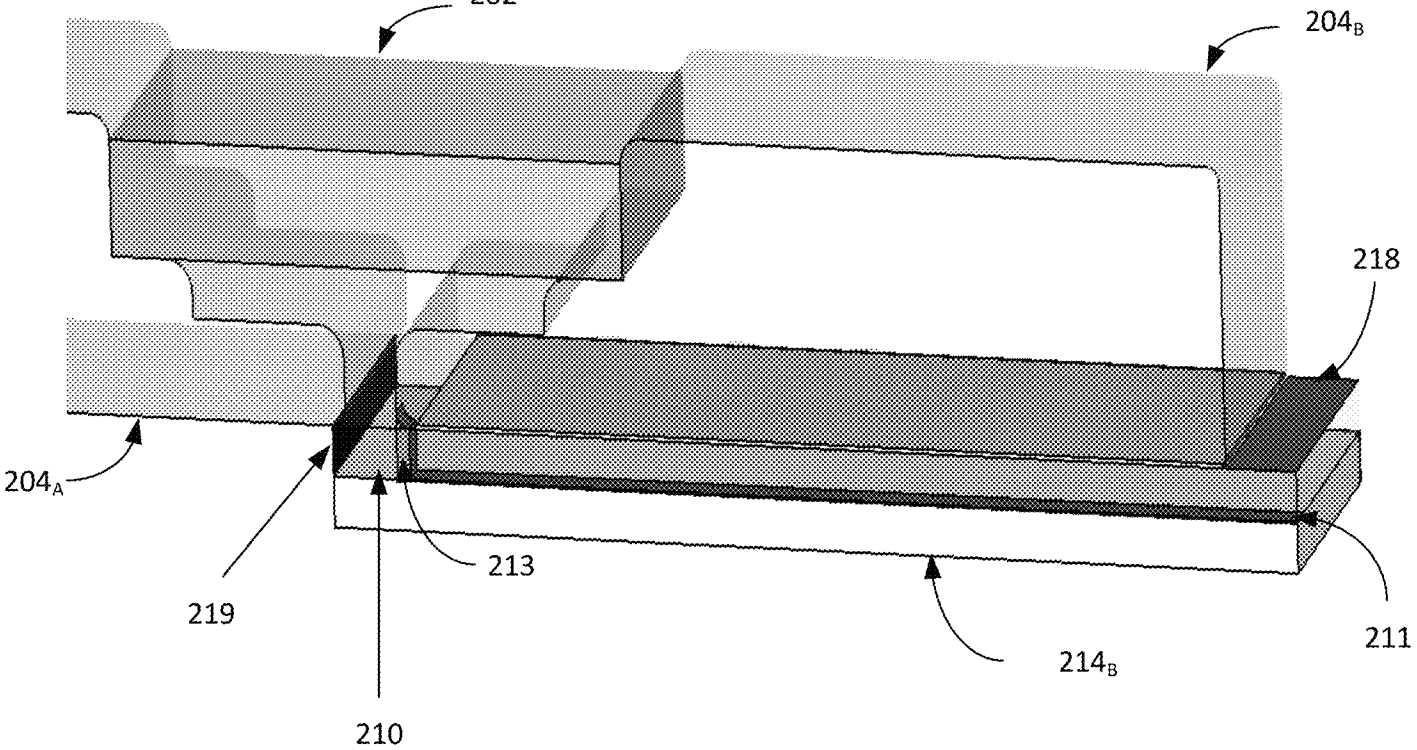
Figure 2G:
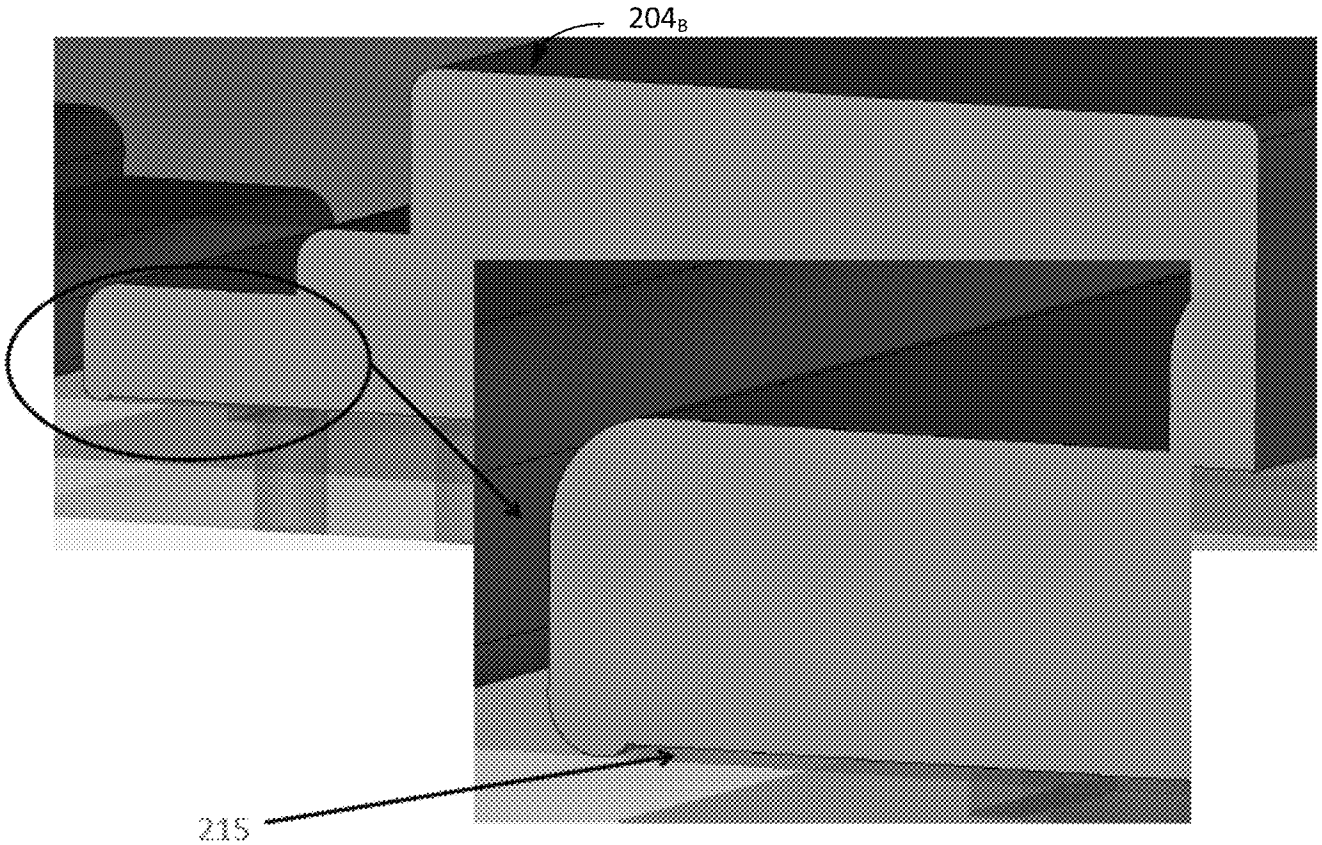

FIGS. 2A-G are schematic diagrams illustrating an element 102, according to an embodiment of the present invention. Enabling features in this embodiment are dielectric radiators, a topology for continuous transition to neighboring elements and feeds in the direction of the electric fields applied to the dielectric that enable dense packing. In this embodiment, element 102 has one or more functional units. As shown in FIG. 2A, for example, element 102 may include a polarization dielectric 202 configured to emit radiation, an antenna body (composed of two pieces $\mathbf{204}_A$, $\mathbf{204}_B$ of rugged dielectric) 204, and a drive mechanism 206. Drive mechanism 206 includes stripline feeds 211, 213, $\mathbf{214}_A$ and $\mathbf{214}_B$ that provide an extremely flat form factor, which is more rugged, surface mountable, and can be made conformal to curved mounting surfaces. See FIG. 2F.

As discussed above, an antenna element is composed of two pieces $\mathbf{204}_A$, $\mathbf{204}_B$. Pieces $\mathbf{204}_A$, $\mathbf{204}_B$ are not directly connected, but are positioned by the presence of polarization dielectric 202 and drive mechanism 206. See also FIG. 2F. In certain embodiments, the longest dimension of an antenna element is approximately half of the wavelength of the central transmission frequency, however, other ratios, e.g. in Very Low Frequency (VLF) applications are possible. The width of an antenna element varies from a few percent of wavelength up to 40 percent of the wavelength. The lower limit of the width is limited by the minimum width of stripline feed 206.

A cut-out 210 exists in the space between ground piece $\mathbf{204}_A$ and electrode piece $\mathbf{204}_B$. Cut-out 210 provides a discrete stepping in impedance for a better match of the radio frequency (RF) power from drive mechanism 206 to polarization dielectric 202. In some embodiments, ground piece $\mathbf{204}_A$ providing the electrode includes one or more additional small steps like 215 underneath electrode piece $\mathbf{204}_B$ towards drive mechanism 206. See FIG. 2G. The resulting gap is filled with a light low epsilon dielectric 212 to insulate electrode piece $\mathbf{204}_B$ from drive mechanism 206, which is enveloped by a grounded shielding. See FIG. 2B. The location and shape of the step are determined by the desire to limit leakage from this gap that would distort the radiated signal.

The ground piece $\mathbf{204}_A$ is fully plated except for the side walls. Electrode piece $\mathbf{204}_B$ is also plated on all faces except for the side walls. These side faces are where neighboring elements touch in an array arrangement. A close physical contact of the elements 102 is required for the proper operation, as physical contact provides an almost tangential boundary condition for the polarization currents. To prevent shorting between electrode pieces $\mathbf{204}_B$ in neighboring elements $\mathbf{102}_i$ and $\mathbf{102}_{i+1}$ that can be under slightly different potential due to element-to-element phasing differences, electrode pieces $\mathbf{204}_B$ have a small chamfer or blend 216 along the touching edges to provide a small break in the plating surfaces. See FIG. 2A.

Polarization dielectric 202 is the radiator for each element in the array. Further, polarization dielectric 202 provides the volume where polarization currents are generated. The strength of radiation and the overall characteristics of an array are determined by the total volume of polarization dielectric 202.

Some embodiments may identify different configurations for different applications. For example, for slow waves (just above the speed of light c), longer, thinner polarization dielectrics can provide sufficient volume. For fast arrays (phase differences between elements provide source speeds of many times c) shorter, thicker elements can be used to reduce the speed variation for consistent radiation patterns. The dielectric constant choice is also part of the antenna concept. While smaller dielectric constants provide better match from the drive to the radiating top, these require larger physical volumes. Higher dielectric constants (e.g. alumina) are more rugged and allow smaller physical volumes, but have a stronger mismatch from the drive to radiation leaving the top of each element.

Some embodiments use, but are not limited to, stripline or micro-stripline feeds 211, 213, $\mathbf{214}_A$ and $\mathbf{214}_B$. With stripline feeds being more open, cross-talk between elements is possible. Shielding by plating the element sides makes the current path separation between ground and electrode very difficult. In some embodiments, stripline feeds 211, 213, $\mathbf{214}_A$ and $\mathbf{214}_B$ include a small number of pairs of pins 208, which are introduced along the sides providing a return path for currents in each element. With this introduction, cross-talk is sufficiently suppressed. The suppression level can be varied by changing the number and spacing of the pins.

In some embodiments, stripline feeds 211, 213, $\mathbf{214}_A$ and $\mathbf{214}_B$ allow use of a single pair of sandwiched printed circuit boards (PCBs) $\mathbf{214}_A$ and $\mathbf{214}_B$ for all array elements. Strip lines 211 and shielding can be printed and the shielding pins can be embedded into PCBs $\mathbf{214}_A$, $\mathbf{214}_B$ at the proper locations. Other embodiments may use further integration by hosting on-board features that include, but are not limited to, phase shifters, amplifiers or direct digital signal synthesis.

The element dielectric pieces $\mathbf{204}_A$ and $\mathbf{204}_B$ are placed on top of the PCBs. For example, an element dielectric piece may sit on a thin dielectric sheet 212 for insulation underneath electrode piece $\mathbf{204}_B$. See FIG. 2B. Underneath dielectric sheet 212 is an electric shield 218 that RF-seals the top of stripline feed assembly (or drive mechanism) 206. See FIG. 2F. The ground piece $\mathbf{204}_A$ is spaced at the proper distance 210 to provide the feeding gaps. See FIG. 2A. Sandwiched PCB pieces $\mathbf{214}_A$ and $\mathbf{214}_B$ are terminated with copper plating 219 connected to the ground piece. See FIG. 2F. Strip line 211 at the entrance to the element gap 210 is connected by a pin 213 to the electrode piece of the element. Thus, the crucial functionality is achieved by forcing the current flow to cross the polarization dielectric as a displacement current to close the current flow.

In an embodiment, an apparatus includes a plurality of antenna elements, which include opposing electrodes that create an electric field exciting polarization currents in an enclosed dielectric. Each of the plurality of antenna elements include one or more stripline feeds that provide a flat form factor and apply a signal with controlled phase differences between each of the plurality of antenna elements.

The apparatus also includes one or more dielectric radiators in each of the plurality of elements that touch at the edges and are parallel to polarization currents within the one or more dielectric radiators.

In some embodiments, each of the plurality of antenna elements include a polarization dielectric that emits radiation, an antenna body composed of a first piece and a second piece of rugged dielectric, and a drive mechanism, which includes the one or more stripline feeds to provide the flat form factor.

In certain embodiments, the one or more stripline feeds are micro-stripline feeds. Also, in certain embodiments, the first piece and the second piece are separate and positioned by the polarization dielectric and the drive mechanism.

A dimension of at least one of the plurality of antenna elements may be half of a wavelength of a central transmission frequency, and a width of the at least one of the plurality of antenna elements may vary from one percent to up to forty percent of the wavelength. A lower limit of the width is limited by a minimum width of the one or more stripline feeds.

In certain embodiments, the apparatus includes a cut-out existing in a space between the first piece and the second piece. This cut-out provides a discrete stepping in impedance for a better match of a RF power from the drive mechanism to the polarization dielectric. The first piece may provide an electrode, which includes one or more additional small steps underneath the second piece towards the drive mechanism. The space is filled with a light low epsilon dielectric to insulate the second piece from the drive mechanism, with the drive mechanism being enveloped by a grounded shielding.

Also, in some embodiments, the first piece is plated on all faces except for side walls, and the second piece is plated on all faces except for the side walls. Side faces of the first piece and the second piece are where neighboring antenna elements touch in an array arrangement.

To prevent shorting between the second piece in neighboring antenna that can be under different potential due to element-to-element phasing differences, the second piece has a chamfer or blend along touching edges to provide a small break in the plating surfaces.

In certain embodiments, the polarization dielectric provides volume where polarization currents are generated, and radiation strength and characteristics of the array are determined by a total volume of the polarization dielectric.

In some further embodiments, the first piece and the second piece are placed on top of PCBs, and an element dielectric piece sits on a thin dielectric sheet for insulation underneath second piece.

In a further embodiment, the apparatus includes an electric shield underneath the dielectric sheet configured to RF-seal a top of the drive mechanism. The first piece is spaced at a predefined distance to provide feeding gaps, and also the first piece and the second piece are terminated with copper plating connected to a ground piece.

In yet a further embodiment, the apparatus includes a strip line at an entrance to the space is connected by a pin to the second piece, thereby forcing current flow to cross the polarization dielectric as a displacement current to close the current flow.

In an alternative embodiment, an antenna array is used as drop-in replacement for phased arrays or for applications that could not be achieved with a flat panel surface mount and conformal shaping to fit mounting surfaces. The antenna array includes an extended dielectric with volume-distributed polarization currents flowing therein emitting radiation. The extended dielectric is continuous or is a series of dielectrics joined together to form an extended shape. The antenna array also includes one or more pairs of electrodes distributed on one or more edges of the extended dielectric generate the polarization currents. The one or more pairs of electrodes with the extended dielectric between the one or more pairs of electrodes for the antenna array.

In this alternative embodiment, the antenna array is based on a solid dielectric block with cut-outs, and the cut-outs are plated to provide the electrodes and shielding and hold a block or blocks of the extended dielectric containing the polarization currents in place between the one or more pairs of electrodes.

It will be readily understood that the components of various embodiments of the present invention, as generally described and illustrated in the figures herein, may be arranged and designed in a wide variety of different configurations. Thus, the detailed description of the embodiments of the present invention, as represented in the attached figures, is not intended to limit the scope of the invention, but is merely representative of selected embodiments of the invention.

The features, structures, or characteristics of the invention described throughout this specification may be combined in any suitable manner in one or more embodiments. For example, reference throughout this specification to "certain embodiments," "some embodiments," or similar language means that a particular feature, structure, or characteristic described in connection with the embodiment is included in at least one embodiment of the present invention. Thus, appearances of the phrases "in certain embodiments," "in some embodiment," "in other embodiments," or similar language throughout this specification do not necessarily all refer to the same group of embodiments and the described features, structures, or characteristics may be combined in any suitable manner in one or more embodiments.

It should be noted that reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout this specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

One having ordinary skill in the art will readily understand that the invention as discussed above may be practiced with steps in a different order, and/or with hardware elements in configurations which are different than those which are disclosed. Therefore, although the invention has been described based upon these preferred embodiments, it would be apparent to those of skill in the art that certain modifications, variations, and alternative constructions would be apparent, while remaining within the spirit and scope of the invention. In order to determine the metes and bounds of the invention, therefore, reference should be made to the appended claims.

The invention claimed is:

1. An apparatus, comprising:

a plurality of antenna elements comprising opposing electrodes to create an electric field exciting polarization currents in an enclosed dielectric, wherein each of the plurality of antenna elements comprising one or more stripline feeds configured to provide a flat form factor and apply a signal with controlled phase differences between each of the plurality of antenna elements; and a drive mechanism comprising the one or more stripline feeds to provide the flat form factor, the one or more stripline feeds comprising a plurality of pins introduced along a side of the one or more stripline feeds providing a return path for currents in each of the plurality of antenna elements.

2. The apparatus of claim 1, further comprising:

one or more dielectric radiators in each of the plurality of elements touch at the edges and are parallel to polarization currents within the one or more dielectric radiators.

3. The apparatus of claim 1, wherein each of the plurality of antenna elements comprising:

a polarization dielectric configured to emit radiation, and an antenna body composed of a first piece and a second piece of dielectric.

4. The apparatus of claim 3, wherein the one or more stripline feeds are micro-stripline feeds.

5. The apparatus of claim 3, wherein the first piece and the second piece are separate and positioned by the polarization dielectric and the drive mechanism.

6. The apparatus of claim 3, wherein a dimension of at least one of the plurality of antenna elements is half of a wavelength of a central transmission frequency, and a width of the at least one of the plurality of antenna elements varies from one percent to up to forty percent of the wavelength.

7. The apparatus of claim 6, wherein a lower limit of the width is limited by a minimum width of the one or more stripline feeds.

8. The apparatus of claim 3, further comprising:

a cut-out existing in a space between the first piece and the second piece, wherein the cut-out provides a discrete stepping in impedance for a better match of a radio frequency (RF) power from the drive mechanism to the polarization dielectric.

9. The apparatus of claim 8, wherein the first piece providing an electrode comprises one or more additional small steps underneath the second piece towards the drive mechanism.

10. The apparatus of claim 8, wherein the space is filled with a light low epsilon dielectric to insulate the second piece from the drive mechanism, the drive mechanism being enveloped by a grounded shielding.

11. The apparatus of claim 3, wherein the first piece is plated on all faces except for side walls, and the second piece is plated on all faces except for the side walls, wherein side faces of the first piece and the second piece are where neighboring antenna elements touch in an array arrangement.

12. The apparatus of claim 3, wherein, to prevent shorting between the second piece in neighboring antenna that can be under different potential due to element-to-element phasing differences, the second piece has a chamfer or blend along touching edges to provide a small break in the plating surfaces.

13. The apparatus of claim 3, wherein the polarization dielectric provides volume where polarization currents are generated, and radiation strength and characteristics of the array are determined by a total volume of the polarization dielectric.

14. The apparatus of claim 3, wherein the first piece and the second piece are placed on top of printed circuit boards (PCBs), and an element dielectric piece sits on a thin dielectric sheet for insulation underneath second piece.

15. The apparatus of claim 14, further comprising:

an electric shield underneath the dielectric sheet configured to RF-seal a top of the drive mechanism.

16. The apparatus of claim 14, wherein the first piece is spaced at a predefined distance to provide feeding gaps.

17. The apparatus of claim 14, wherein the first piece and the second piece are terminated with copper plating connected to a ground piece.

18. The apparatus of claim 14, further comprising:

a strip line at an entrance to a space is connected by a pin to the second piece, thereby forcing current flow to cross the polarization dielectric as a displacement current to close the current flow.

19. An apparatus, comprising:

a plurality of antenna elements comprising opposing electrodes to create an electric field exciting polarization currents in an enclosed dielectric, wherein each of the plurality of antenna elements comprising:

one or more stripline feeds configured to provide a flat form factor and apply a signal with controlled phase differences between each of the plurality of antenna elements;

each of the plurality of antenna elements comprising:

a polarization dielectric configured to emit radiation, an antenna body composed of a first piece and a second piece of dielectric, and a drive mechanism comprising the one or more stripline feeds to provide the flat form factor; and a dimension of at least one of the plurality of antenna elements is half of a wavelength of a central transmission frequency, and a width of the at least one of the plurality of antenna elements varies from one percent to up to forty percent of the wavelength.

* * * * *